US006041508A

United States Patent [19]

David

[11] Patent Number: 6,041,508

[45] Date of Patent: Mar. 28, 2000

[54] AIMING APPARATUS

[76] Inventor: Yair David, 6 Ankor St., Ramat Hasharon 47229, Israel

[21] Appl. No.: 08/974,841

[22] Filed: Nov. 20, 1997

[30] Foreign Application Priority Data

May 16, 1997 [IL] Israel ..... 120840

[51] Int. Cl.[7] ..... F41G 21/00; F41G 1/46; F41G 1/32

[52] U.S. Cl. ..... 33/233; 42/100; 33/241

[58] Field of Search ..... 33/233, 241; 42/100

[56] References Cited

U.S. PATENT DOCUMENTS

| | | | |
|---|---|---|---|
| 3,453,385 | 7/1969 | Capellaro | 42/100 |
| 3,824,699 | 7/1974 | Lenz et al. | 42/100 |
| 3,914,873 | 10/1975 | Elliott, Jr. et al. | 33/241 |
| 4,624,641 | 11/1986 | Gallagher | 33/233 |
| 4,711,512 | 12/1987 | Upatnieks . | |
| 4,878,305 | 11/1989 | Gabrielidis | 42/100 |
| 5,272,514 | 12/1993 | Dor | 356/251 |
| 5,456,035 | 10/1995 | Stiles | 42/100 |
| 5,483,362 | 1/1996 | Tai et al. . | |
| 5,711,104 | 1/1998 | Schmitz | 42/100 |

OTHER PUBLICATIONS

Friesem et al, "Planar Diffractive Elements for Compact Optics", *Academic Press, N.Y.*, 1996, pp. 125–144.

*Primary Examiner*—Charles T. Jordan
*Assistant Examiner*—Denise J. Buckley
*Attorney, Agent, or Firm*—Mark M. Friedman

[57] ABSTRACT

An apparatus for aiming a device such as a gun or a camera at a target without holding the device near the user's face. The apparatus has two sections: a viewer and an irradiator. The irradiator is rigidly attached to the device to be aimed, and projects towards the viewer an indication of the direction in which the device is aimed. The viewer includes an eyeport, through which the user observes the target, and a mechanism for projecting on the eyeport an indication of the deviation from the target of the aim of the device to be aimed. Preferably, the irradiator includes two light sources collinear with the aiming axis of the device to be aimed, and the viewer mechanism is based on planar optics.

30 Claims, 8 Drawing Sheets

AIMING APPARATUS

FIELD AND BACKGROUND OF THE INVENTION

The present invention relates to an aiming apparatus and, more particularly, to an apparatus that allows a user to aim an aimable device at a target while looking directly at the target and without holding the aimable device close to the user's face.

There are a variety of devices which, in use, are aimed at targets. These include, for example, guns, cameras and range finders. These devices are referred to herein as "aimable" devices, because a user of such a device typically aims the device by holding the device close to his or her face and looking at the target via an aiming apparatus mounted directly on the device. For example, a gun is aimed at a target by looking through a gunsight, and a camera is aimed at a target by looking through a viewfinder.

In some applications of these aimable devices, the user is unable to aim the device carefully at the target. For example, in a hostage rescue situation, a law enforcement officer may not have time to aim carefully at a kidnapper, but may need to "shoot from the hip" instead; or a news photographer in a crowd may need to hold his or her camera above the heads of the crowd to get a clear shot at a celebrity. In such circumstances, the aimable device cannot be held close to the user's face for aiming.

There is thus a widely recognized need for, and it would be highly advantageous to have, an aiming apparatus that allows an aimable device to be aimed at a target while being held away from the user's face, and while the user is looking directly at the target.

SUMMARY OF THE INVENTION

According to the present invention there is provided an apparatus for enabling a user to orient an aiming axis of an aimable device at a desired orientation with respect to a line of sight from the user to a target, the apparatus including: (a) an irradiator, adapted to be rigidly mounted on the aimable device and including: (i) a first light source for emitting light of a first color, and (ii) a second light source for emitting light of a second color; and (b) a viewer, operative to move independently of the irradiator when the irradiator is mounted on the aimable device, and including: (i) an eyeport wherethrough the user observes the target, thereby establishing the line of sight, (ii) a viewer axis having a fixed orientation with respect to the line of sight when the user observes the target, the aiming axis having an actual orientation relative to the viewer axis, and (iii) an optical system, including a first input element, for receiving the emitted light of the first color, and a second input element, for receiving the emitted light of the second color, the optical system operative to project onto the eyeport an image, of the emitted light, representative of the actual orientation of the aiming axis relative to the viewer axis.

According to the present invention there is provided a method for holding a device that has an aiming axis with the aiming axis at a desired orientation with respect to a user's line of sight, including the steps of: (a) providing the device with a irradiator that includes: (i) a first light source for emitting light of a first color, and (ii) a second light source for emitting light of a second color; (b) providing the user with a viewer, operative to move independently of the irradiator, and including: (i) an eyeport, (ii) a viewer axis, and (iii) an optical system, including a first input element, for receiving the emitted light of the first color, and a second input element, for receiving the emitted light of the second color; (c) positioning the viewer with respect to the user so that the viewer axis is oriented at a first intermediate orientation with respect to the user's line of sight when the user looks through the eyeport, the optical system being operative to project onto the eyeport an image, of the emitted light, indicating a deviation of the aiming axis from a second intermediate orientation with respect to the viewer axis, the aiming axis being at the desired orientation with respect to the user's line of sight when the viewer axis is at the first intermediate orientation with respect to the line of sight and the aiming axis is at the second intermediate orientation with respect to the viewer axis; (d) positioning the device relative to the viewer so that the optical system receives the emitted light and projects the image onto the eyeport, the light emitted by the first light source being received via the first input element and the light emitted by the second light source being received by the second input element; and (e) further positioning the device relative to the viewer so that the image indicates that the aiming axis is at the second intermediate orientation with respect to the viewer axis.

The apparatus of the present invention has two parts, an irradiator that is rigidly mounted on the aimable device, and a viewer that is worn by the user, preferably through being attached to a headset such as a hat or helmet, so that the viewer eyepiece is adjacent to one of the user's eyes and the viewer axis is oriented at a fixed angle with respect to the line of sight from the user's eye to the target when the user looks directly at the target through the eyepiece. The angle between the viewer axis and the line of sight depends on the intended application: to aim the aimable device at the target, this angle is zero, so that the viewer axis is parallel to the line of sight. Preferably, the irradiator is provided with two light sources that direct light at the viewer from two points on the irradiator, those two points defining an irradiator axis that is oriented at another fixed angle with respect to the aimable device's aiming axis. As in the case of the angle between the viewer axis and the line of sight, this angle depends on the desired application, and need not be zero. In the main application of the apparatus of the present invention, the aiming of the aimable device at the target, both angles are zero, and the irradiator axis is parallel to the aiming axis. The viewer includes an optical system that receives the light from the irradiator and projects that light on the eyeport in the form of two spots that coincide when the viewer axis is parallel to the aiming axis and otherwise generally do not coincide. Preferably, the viewer includes a mechanism for projecting a reticle pattern onto the eyeport. Most preferably, both the optical system and the projection mechanism are based on planar optics, although the scope of the present invention includes optical systems and projection mechanisms based on geometric optics.

A user equipped with the apparatus of the present invention faces the target while looking through the eyeport at the target, and moves the aimable device until the image in the eyeport indicates that the aimable device is aimed at the target, within certain systematic limitations such as parallax, as discussed below. In the preferred embodiment of the present invention, this situation obtains when the two spots projected on the eyeport coincide. It should be noted that the present invention does not require that the target be illuminated or "painted" with light such as visible light or infrared light in order to aim the aimable device at the target. As noted below, there also are orientations of the aimable device that are not parallel to the view axis that also produce coincidence of the two spots, but it usually is easy for the user to distinguish those orientations from the desired orientation.

Another systematic error associated with the main application of the present invention, the aiming of an aimable device at a target, is parallax. Strictly speaking, the aiming point of the aimable device is not on the target, but is displaced perpendicular to the line of sight by the distance by which the aiming axis is displaced from the line of sight. At long ranges to sufficiently large targets, error due to parallax may not matter. At short ranges, it often is easy for the user to compensate for parallax. For example, in the hostage rescue situation noted above, the law enforcement officer can aim at an erect kidnapper's belly by looking at the kidnapper's head.

It will be appreciated that the scope of the present invention includes other apparati that accomplish similar results. For example, the irradiator may include a television camera aimed parallel with the aiming axis and a gyroscopic system for sensing the orientation of the irradiator, and the viewer may include a miniaturized television receiver upon which the user observes both the target and a visual indication of the orientation of the aiming axis with respect to the target. The preferred embodiment described briefly above and in more detail below has the advantages of relative cheapness and simplicity compared to these other embodiments, in addition to affording the user an unobstructed binocular view of the target and its surroundings.

Although the main application of the present invention is to the orientation of an aimable device parallel to the user's line of sight, with the viewer axis parallel to the user's line of sight, it will be appreciated that the present invention may be used to orient any device at any desired orientation with respect to the user's line of sight, as long as the orientation of the viewer axis with respect to the user's line of sight and the orientation of the irradiator axis with respect to the device being oriented combine to produce the desired orientation of the device with respect to the user's line of sight when the irradiator axis is parallel to the viewer axis. This non-parallel orientation of a device with respect to the user's line of sight may be used, for example, to compensate for parallax if the distance to the target is known.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of an apparatus which can be used to orient a device with respect to the user's line of sight without looking at the device, and of a method for its use. Specifically, the present invention can be used to aim an aimable device such as a gun towards a target while looking directly at the target and without looking at the aimable device or holding the aimable device near the user's face.

The principles and operation of an aiming apparatus according to the present invention may be better understood with reference to the drawings and the accompanying description.

Figure 1:
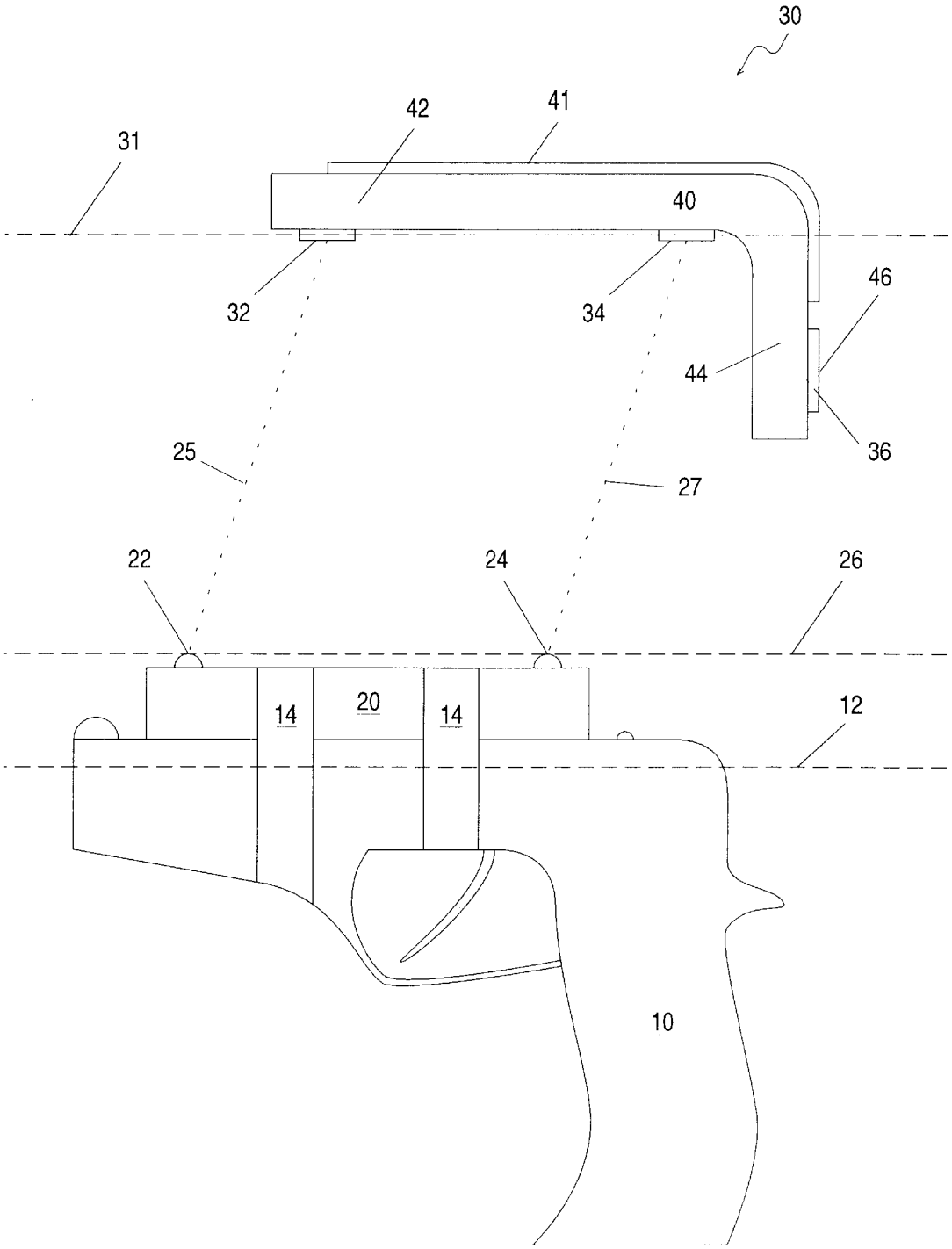
FIG. 1 is a schematic side view of the apparatus of the present invention used to aim a pistol.

Referring now to the drawings, FIG. 1 is a schematic side view of the apparatus of the present invention as used to aim an aimable device, in this case a pistol 10. Pistol 10 features an aiming axis 12 parallel to the barrel of pistol 10: at short ranges, the trajectory of a bullet fired, by pistol 10 Is approximately linear, so pistol 10 is aimed at a nearby target by pointing the barrel of pistol 10 directly at the target. (In the case of the aimable device being an optical device such as a camera or a rangefinder, the trajectory of photons from the target to the device is linear at all ranges.) Rigidly mounted on pistol 10, by means of straps 14, is an irradiator 20 bearing two LEDs 22 and 24 LED 22 emits light 25 of a first color (for example, red) and LED 24 emits light 27 of a second color (for example, blue). LEDs 22 and 24 define between them an irradiator axis 26 that is parallel to aiming axis 12.

Also provided is a viewer 30. The body of viewer 30 is a transparent holographic plate 40 having an input section 42 and an output section 44 that are mutually perpendicular. On input section 42 are mounted two input holographic elements 32 and 34. Input elements 32 and 34 define between them a viewer axis 31. On output section 44 is mounted an output holographic element 36 that defines an eyeport 46. Light 25 from LED 22 enters holographic plate 40 via input element 32 and propagates through holographic plate 40 by total internal reflection to form a first colored spot on output element 36. Light 27 from LED 24 enters holographic plate 40 via input element 34 and propagates through holographic plate 40 by total internal reflection to form a second colored spot on output element 36. Optionally, holographic plate 40 is partially coated with a reflective coating 41, particularly on and near the transition region between input section 42 and output section 44. Input elements 32 and 34 are spaced apart by the same distance as the distance between LEDs 22 and 24, so that when viewer 30 and irradiator 20 are oriented with axes 26 and 31 parallel, as shown in FIG. 1, rays of light 25 from LED 22 to input element 32 and of light 27 from LED 24 to input element 34 also are parallel, so the two spots coincide. Output element 36 diverts the light impinging thereon to leave holographic plate 40, so that a user looking at output element 36 sees the two spots of light, and, in particular, sees that the two spots of light are coincident when axes 26 and 31 are parallel.

Further details of the principles of planar optics, upon which the embodiment of FIG. 1 is based, and especially of means of constructing holographic elements, can be found, for example, in A. A. Friesem and Y. Amitai (1996), "Planar diffractive elements for compact optics", *Trends in Optics* (A. Consortini. ed.). Academic Press, NY, pp. 125–144, which is incorporated herein by reference for all purposes as if fully set forth herein. Most preferably, input elements 32 and 34 include negative lenses, and output element 36 includes a positive lens, so that holographic plate 40 functions as a planar Galilean telescope, as described on pp. 140–141 of Friesem and Amitai, enlarging the image of the two colored spots as seen via output element 36 and thereby increasing the sensitivity of the apparatus of the present invention.

Figure 2:
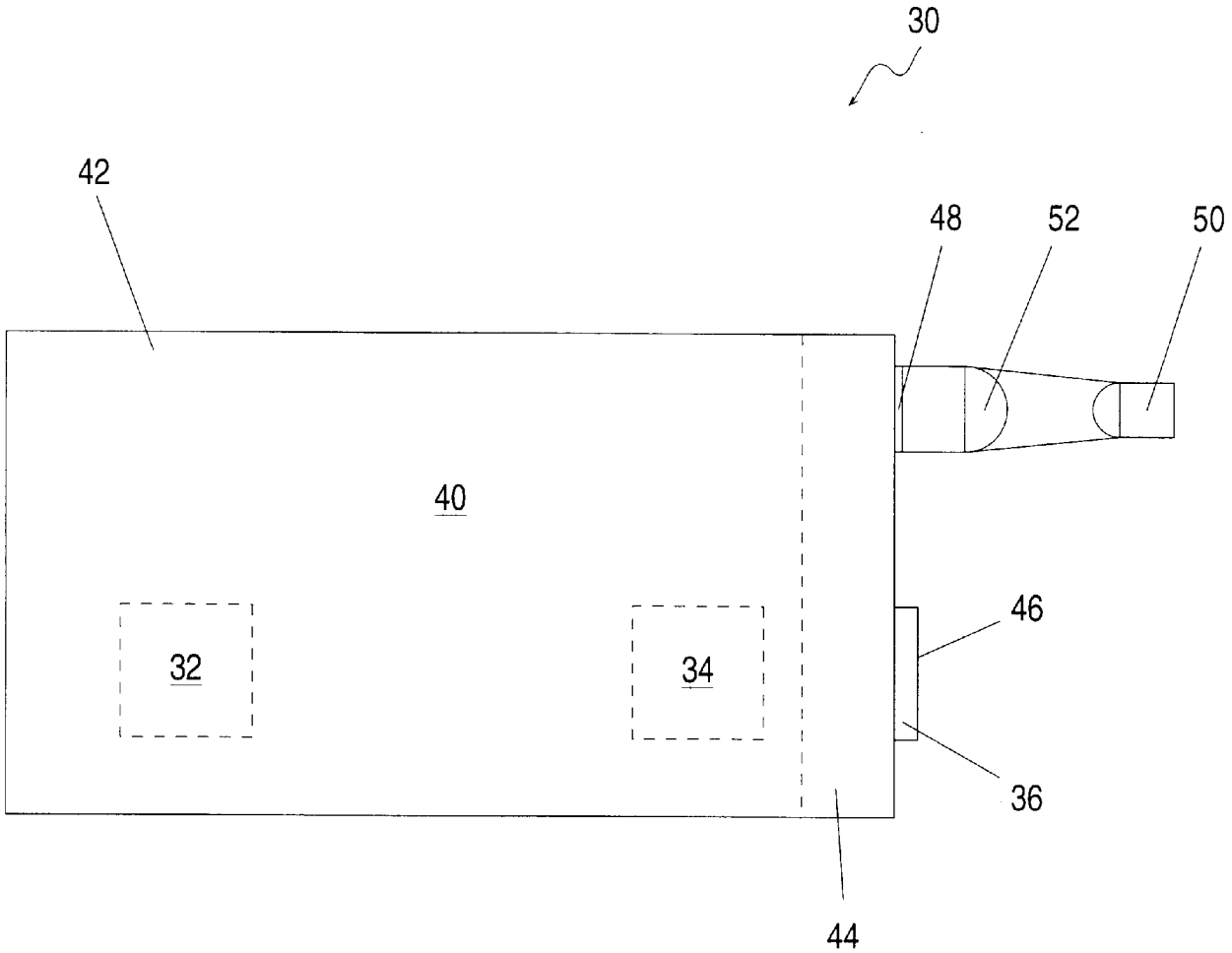
FIG. 2 is a schematic top view of the viewer of FIG. 1.

FIG. 2 is a schematic top view of viewer 30, showing that, in addition to output element 36, output section 44 is provided with a third holographic input clement 48, a miniature cathode ray tube 50 for projecting the image of a reticle onto input element 48, and a conventional (refractive, as opposed to holographic) lens 52 for collimating the light from cathode ray tube 50 onto input element 48. Light traversing input element 48 enters output section 44 and propagates by internal reflection to output element 36. Output section 44 is substantially a miniature copy of the head-up display taught by Upatnieks in U.S. Pat. No. 4.711.512, except that input element 48 and output element 36 are on the same side of output section 44.

Figure 3:
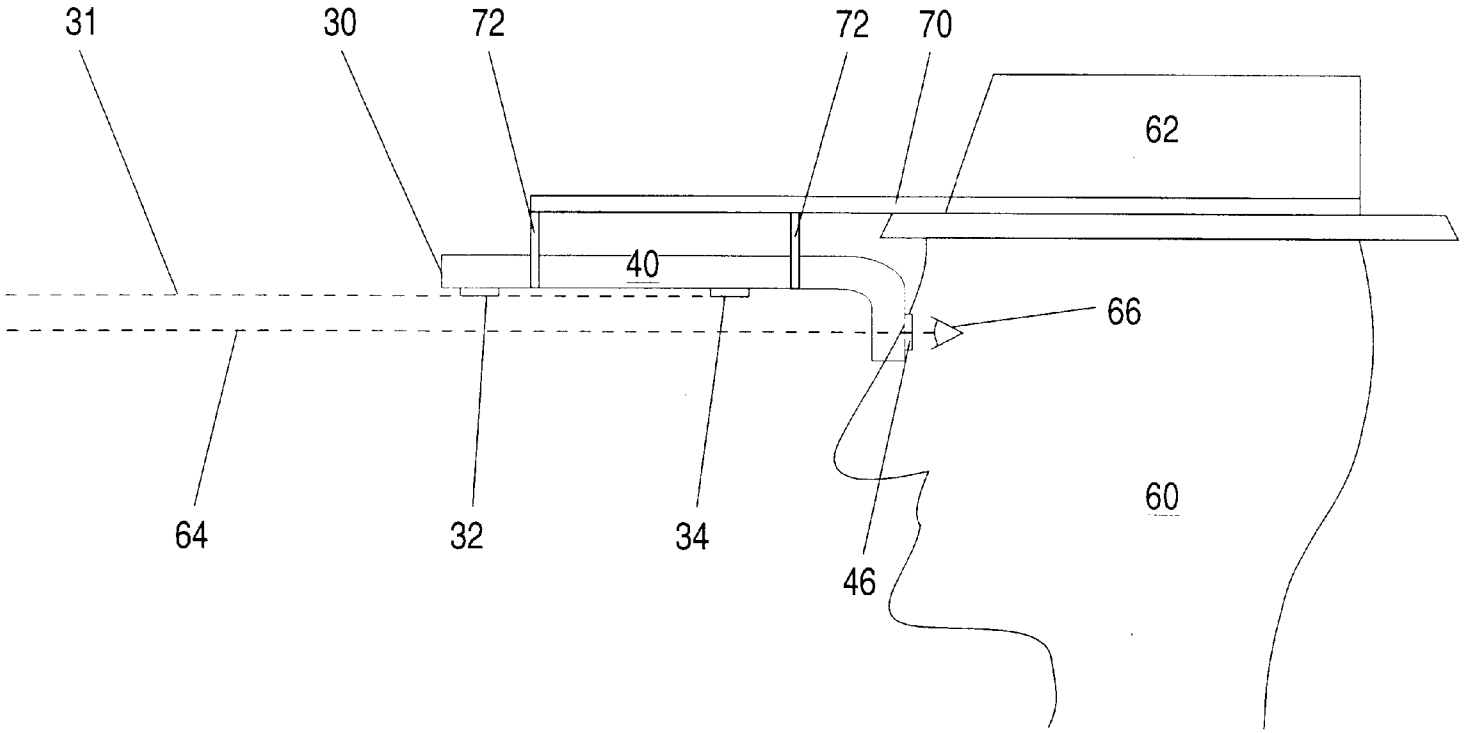
FIG. 3 shows the viewer of FIG. 1 mounted on a headset worn by a user.

FIG. 3 is a schematic illustration of viewer 30 mounted on a headset 62 (in this case a hat) and worn by a user 60. Viewer 30 is attached to hat 62 by a frame 70 and bands 72, so that when user 60 wears hat 62, eyeport 46 is adjacent to left eye 66 of user 60, and axis 31 is parallel to line of sight 64 of user 60. Because holographic plate 40 is transparent, user 60 sees the target both with left eye 66 through eyeport 46 and directly with user 60's unobstructed right eye.

Figure 4A:
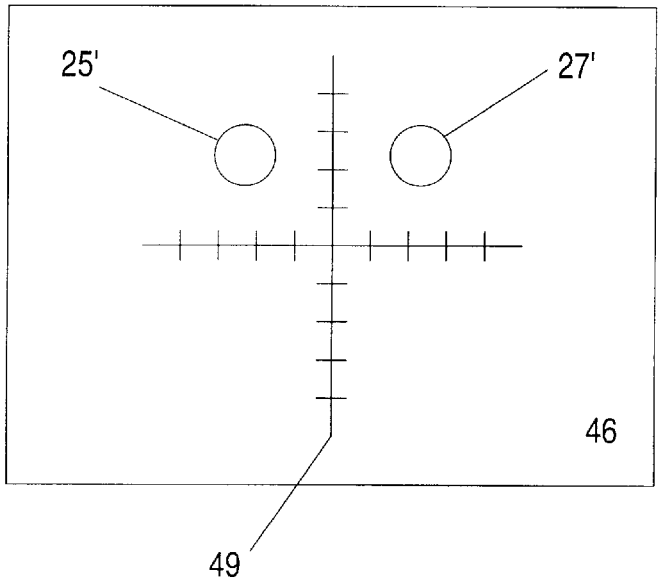
FIG. 4A shows the appearance of the eyeport of the viewer of FIG. 1 when the pistol of FIG. 1 is not aimed parallel to the viewer axis.
Figure 4B:
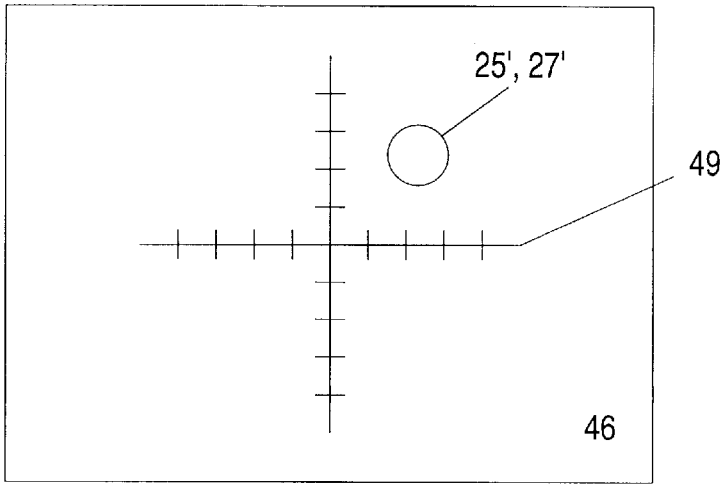
FIG. 4B shows the appearance of the eyeport of the viewer of FIG. 1 when the pistol of FIG. 1 is aimed parallel to the viewer axis.

FIGS. 4A and 4B show the appearance of eyeport 46 under two circumstances. FIG. 4A shows the appearance of eyeport 46 when axes 26 and 31 are not parallel: spot 25' of light 25 and spot 27' of light 27 do not coincide. FIG. 4B shows the appearance of eyeport 46 when axes 26 and 31 are parallel: spots 25' and 27' coincide. Also shown in FIGS. 4A and 4B is an image 49 of an illustrative reticle pattern projected onto eyeport 46 by cathode ray tube 50.

Figure 5:
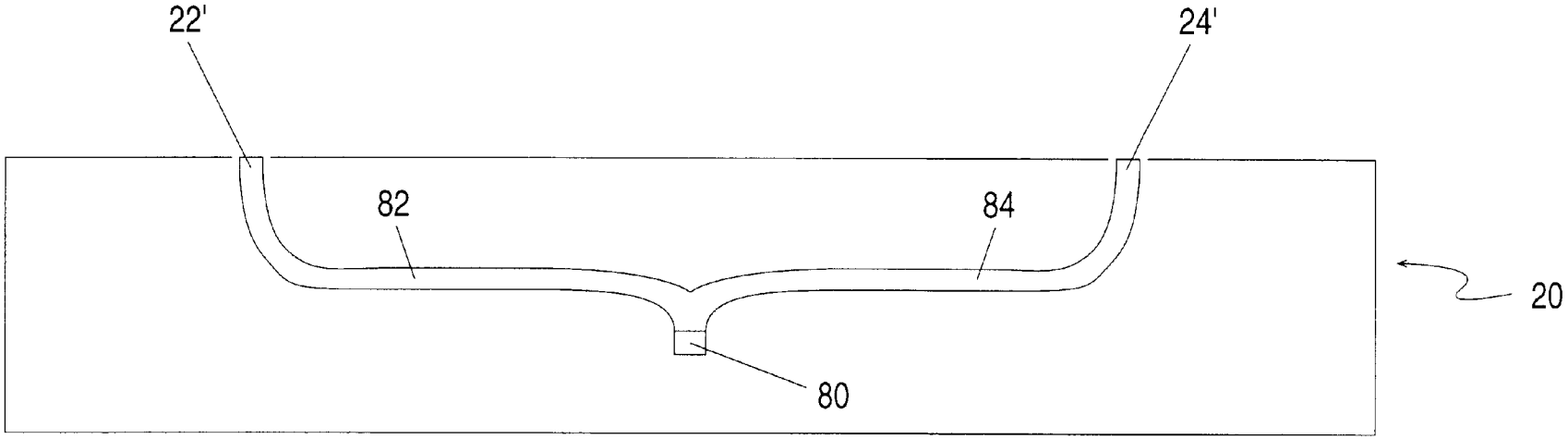
FIG. 5 is a schematic cross section of a variant of the irradiator of FIG. 1.

It will be appreciated that the sources of light in irradiator 20 need not be active sources such as LEDs 22 and 24. These sources may be passive sources, such as optical elements that divert light from a different active source within irradiator 20, as long as these passive sources are located on the surface of irradiator 20 in the positions of LEDs 22 and 24. FIG. 5 is a schematic cross section of a variant 20' of irradiator 20 in which light from a LED 80 is conducted by optical fibers 82 and 84 to ports 22' and 24'. Port 22' is in the same location on irradiator 20' as LED 22 is on irradiator 20, and port 24' is in the same location on irradiator 20' as LED 24 is on irradiator 20. Note that the light emerging from port 22' is of the same color as the light emerging from port 24'. so that spots 25' and 27' have the same color. Alternatively, a wide spectrum source may be used in place of LED 80, and colored filters may be provided at ports 22' and 24' so that spots 25' and 27' have different colors as before.

Figure 6:
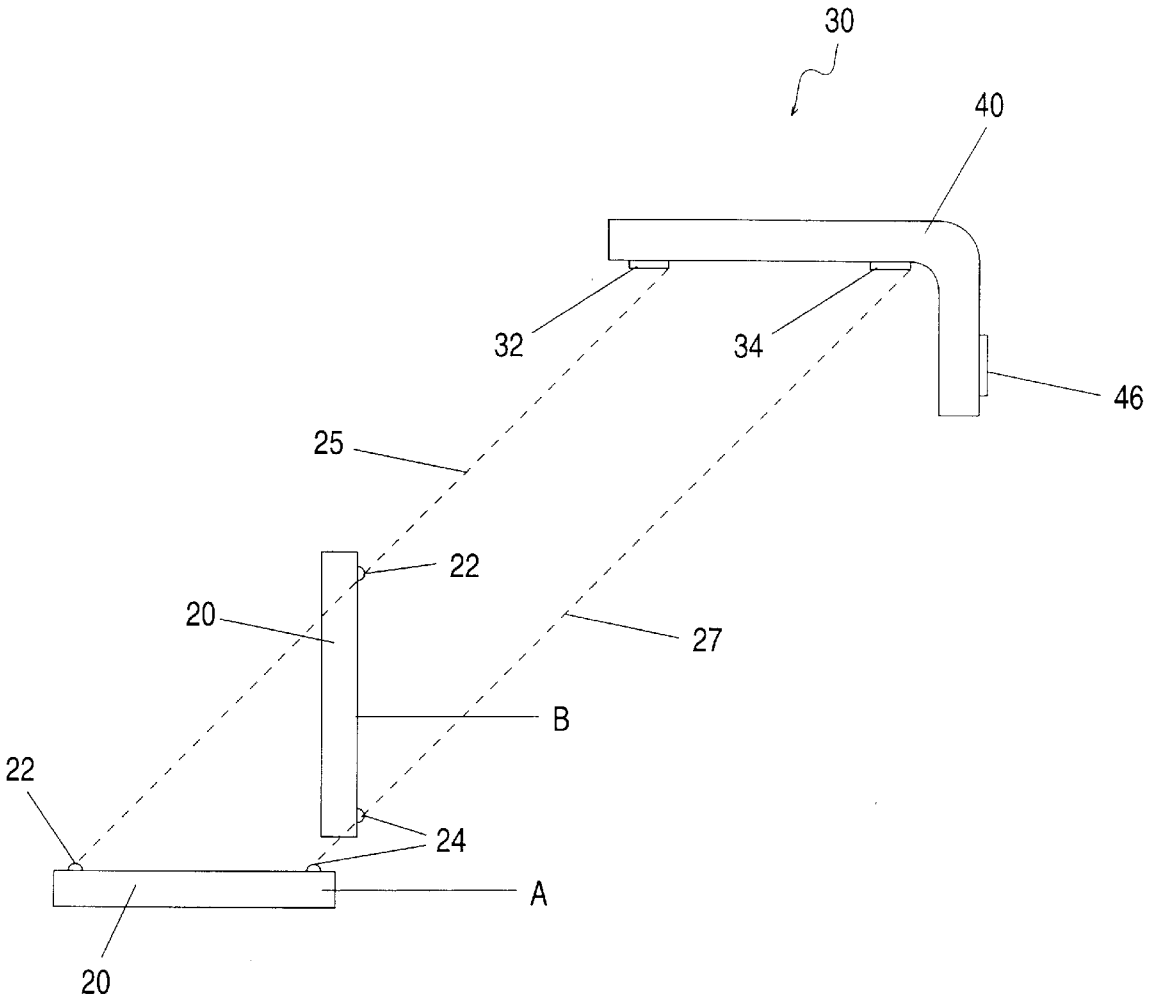
FIG. 6 illustrates a possible ambiguity in the use of the present invention.

FIG. 6 illustrates a possible but unlikely source of ambiguity in the use of the present invention. As described above, when irradiator 20 is in position A, with axis 26 parallel to axis 31, rays of light 25 and 27 entering viewer 30 through input elements 32 and 34 are parallel, and so create coincident spots 25' and 27' on eyeport 46. For each position A, there is one other position of irradiator 20, position B, in which rays of light 25 and 27 are parallel as they enter viewer 30 through input elements 32 and 34, thereby creating coincident spots 25' and 27' on eyeport 46. It will be appreciated that in almost all cases, user 60 is able to tell from the feel of aimable device 10 whether aimable device 10 and irradiator 20 are in position A or position B, without having to look at aimable device 10.

Figure 7:
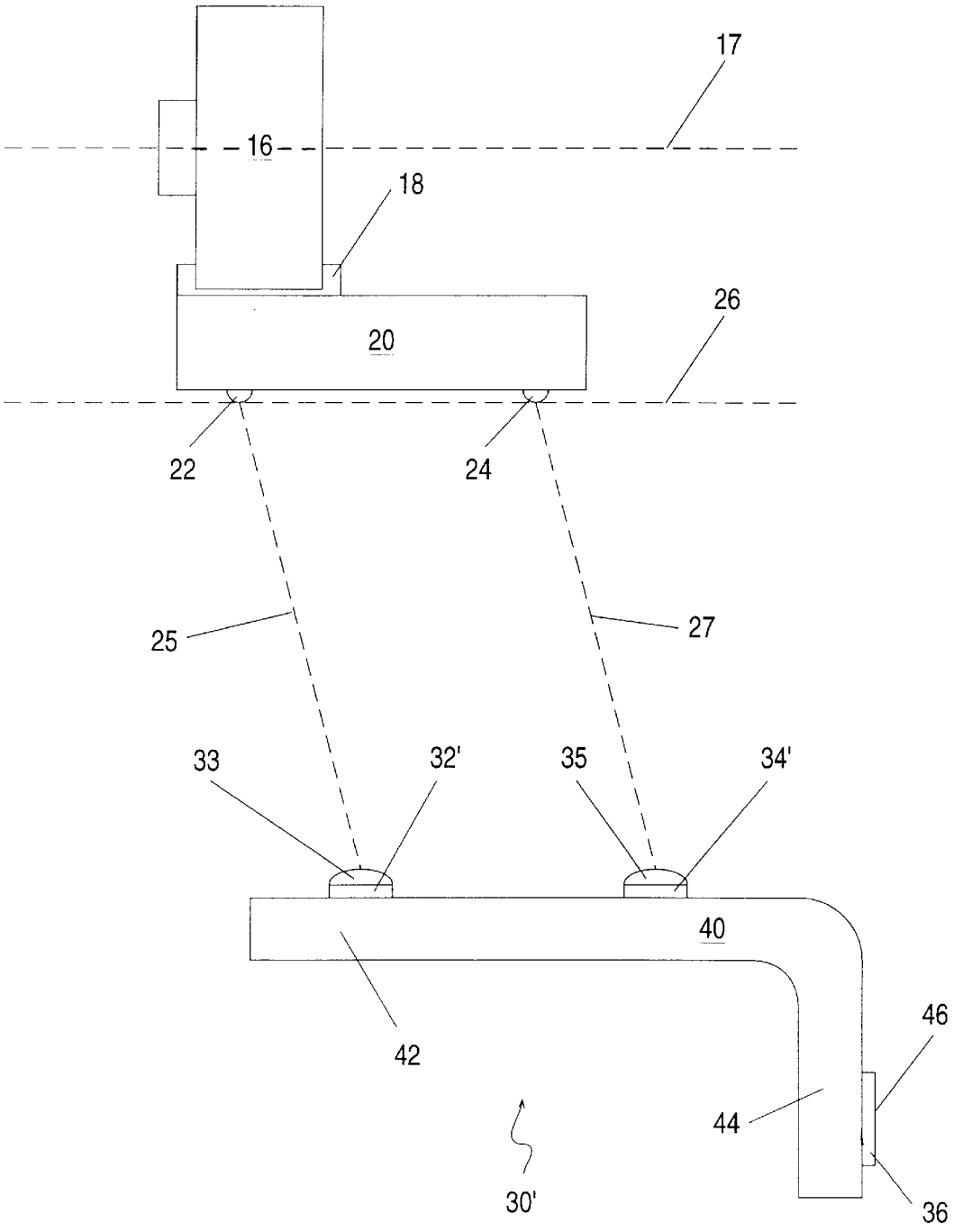
FIG. 7 is a schematic side view of the apparatus of the present invention used to aim a camera.

FIG. 7 is a schematic side view of the apparatus of the present invention as used to aim a camera 16 above the heads of a crowd. Camera 16 has an aiming axis 17, similar to aiming axis 12 of pistol 10. Camera 16 is rigidly mounted on irradiator 20 by means of a mount 18 so that irradiator axis 26 and aiming axis 17 are parallel. Viewer 30' is substantially identical to viewer 30, except that, unlike input holographic elements 32 and 24, which are on the bottom of input section 42, input holographic elements 32' and 34' are on top of input section 42, and are provided with collimating refractive lenses 33 and 35 respectively. Depending on the design of the input holographic elements, the input holographic elements may provide sufficient collimation of light 25 and 27 without requiring supplemental collimation by refractive or other geometric optic elements, as in the case of viewer 30: or the input holographic elements may require supplemental collimation, as in the case of viewer 30'. Similarly, it will be appreciated that the mechanism for projecting image 49 onto output element 36 may be positioned on the side of output section 44 opposite to output element 36, rather than on the same side as in FIG. 2.

Figure 8:
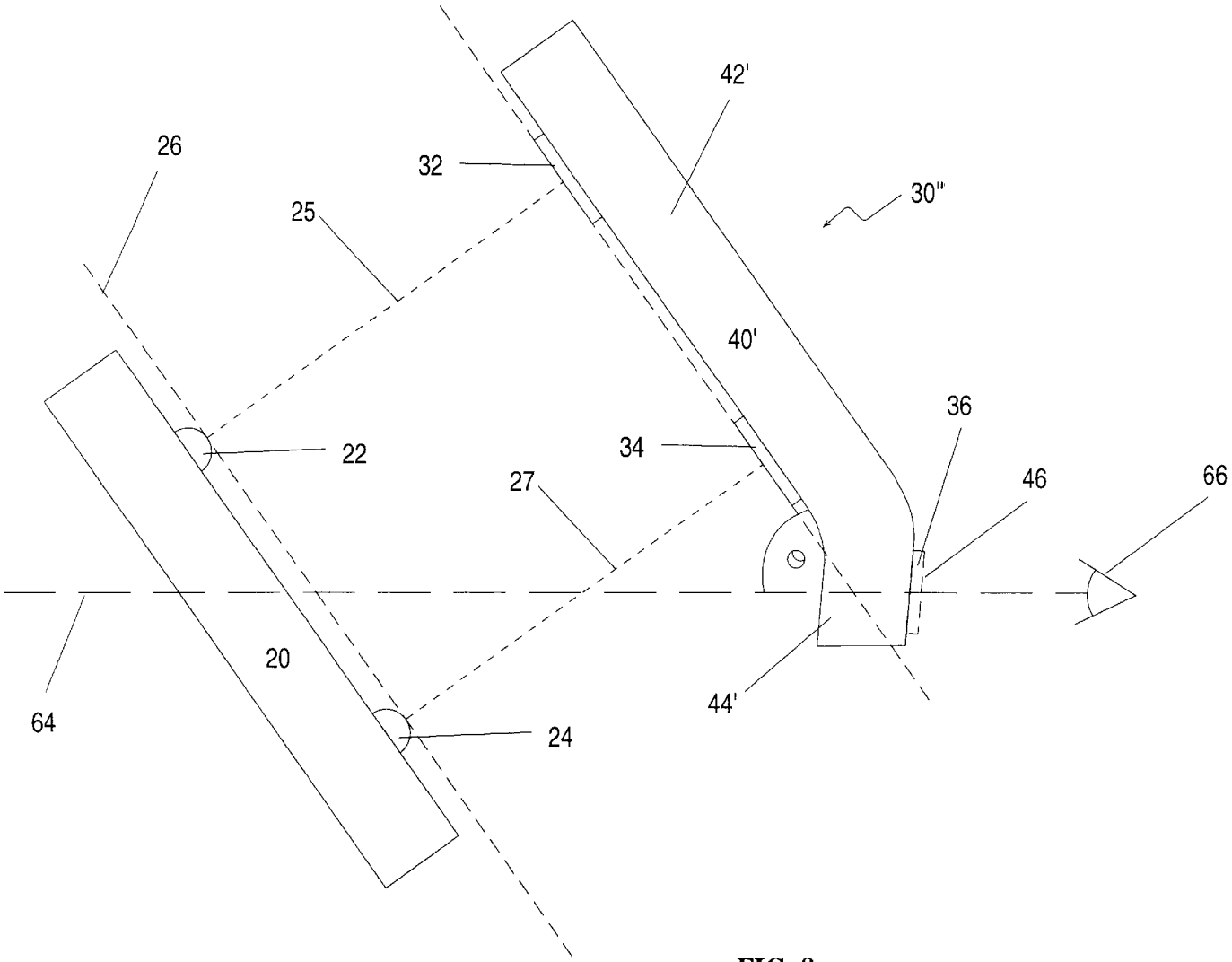
FIG. 8 is a schematic illustration of the use of the present invention to orient a device obliquely to the user's line of sight.

As noted above, the present invention may be used to orient any device at any desired orientation with respect to line of sight 64. FIG. 8 illustrates schematically the use of irradiator 20 and a variant 30" of viewer 30 to orient a device (not shown) at an angle $\sigma$ to line of sight 64. Viewer 30" differs from viewer 30 in that input section 42' and output section 44' of holographic plate 40' of viewer 30" are at an angle $\pi/2-\sigma$ (the angle complementary to $\sigma$) to each other, unlike input section 42 and output section 44 of holographic plate 40 of viewer 30, which are mutually perpendicular. Therefore, the coincidence of spots 25' and 27' on eyeport 46 of viewer 30' indicates that irradiator axis 26 is at angle $\sigma$ to line of sight 64. One special case of this non-parallel orientation of the oriented device with respect to line of sight 64 is that of perpendicular orientation, in which $\sigma=\pi/2$ and input section 42' is parallel to output section 44'. Similarly, irradiator 20 may be mounted on the oriented device with irradiator axis 26 at a non-zero angle as with respect to the device.

While the invention has been described with respect to a limited number of embodiments, it will be appreciated that many variations, modifications and other applications of the invention may be made.

What is claimed is:

1. An apparatus for enabling a user to orient an aiming axis of an aimable device at a desired orientation with respect to a line of sight from the user to a target, the apparatus comprising:

(a) an irradiator, adapted to be rigidly mounted on the aimable device and including:

(i) a first light source for emitting light of a first color, and (ii) a second light source for emitting light of a second color; and (b) a viewer, operative to move independently of said irradiator when said irradiator is mounted on the aimable device, and including:

(i) an eyeport wherethrough the user observes the target, thereby establishing the line of sight, (ii) a viewer axis having a fixed orientation with respect to the line of sight when the user observes the target, the aiming axis having an actual orientation relative to said viewer axis, and (iii) an optical system, including a first input element, for receiving said emitted light of said first color, and a second input element, for receiving said emitted light of said second color, said optical system operative to project onto said eyeport an image, of said emitted light, representative of said actual orientation of the aiming axis relative to said viewer axis.

2. The apparatus of claim 1, wherein said fixed orientation of said viewer axis with respect to the line of sight is a parallel orientation.

3. The apparatus of claim 1, wherein said fixed orientation of said viewer axis with respect to the line of sight is a perpendicular orientation.

4. The apparatus of claim 1, further comprising:

(c) a headset, whereon said viewer is mounted so that said viewer axis has said fixed orientation with respect to the line of sight from the user to the target when said headset is worn by the user.

5. The apparatus of claim 1, wherein said first light source and said second light source define between them an irradiator axis that is at a fixed orientation relative to the aiming axis when said irradiator is mounted on the aimable device.

6. The apparatus of claim 5, wherein said fixed orientation of said irradiator axis relative to the aiming axis is a parallel orientation.

7. The apparatus of claim 5, wherein said first color and said second color are substantially identical.

8. The apparatus of claim 1, wherein said image of said emitted light includes a first spot of said light from said first light source and a second spot of said light from said second light source, said aiming axis being oriented at the desired orientation with respect to the line of sight from the user to the target when said first spot and said second spot coincide.

9. The apparatus of claim 1, wherein said first input element and said second input element define between them said viewer axis.

10. The apparatus of claim 9, wherein said first light source and said second light source are separated by a certain distance, and wherein said first input element and said second input element are separated by substantially said certain distance.

11. The apparatus of claim 9, wherein said first input element and said second element each includes a mechanism for collimating said light that enters said optical system from said light sources, each of said mechanisms for collimating said light including at least one optical element selected from the group consisting of refractive lenses and holographic elements.

12. The apparatus of claim 1, wherein said optical system is based on planar optics.

13. The apparatus of claim 12, wherein said optical system includes a holographic plate having an input section including a first input holographic element and a second input holographic element that define between them said viewer axis.

14. The apparatus of claim 13, wherein said holographic plate includes an output section at an orientation with respect to said input section that is substantially complementary to said fixed orientation of said viewer axis to the line of sight.

15. The apparatus of claim 14, wherein said eyeport includes an output holographic element adjacent to said output section.

16. The apparatus of claim 15, wherein said first input holographic element and said second input holographic element include negative lenses, and said output holographic element includes a positive lens, so that said holographic plate functions as a planar telescope.

17. The apparatus of claim 13, wherein said holographic plate is partially covered by a reflective coating.

18. The apparatus of claim 1, wherein said viewer further includes:

(iv) a mechanism for projecting a reticle pattern onto said eyeport.

19. The apparatus of claim 18, wherein said mechanism includes a cathode ray tube.

20. The apparatus of claim 1, wherein said first and second light sources are passive.

21. A method for holding a device that has an aiming axis with the aiming axis at a desired orientation with respect to a user's line of sight, comprising the steps of:

(a) providing the device with an irradiator that includes:
  (i) a first light source for emitting light of a first color, and
  (ii) a second light source for emitting light of a second color;

(b) providing the user with a viewer, operative to move independently of said irradiator, and including:
  (i) an eyeport,
  (ii) a viewer axis, and
  (iii) an optical system, including a first input element, for receiving said emitted light of said first color, and a second input element, for receiving said emitted light of said second color;

(c) positioning said viewer with respect to the user so that said viewer axis is oriented at a first intermediate orientation with respect to the user's line of sight when the user looks through said eyeport, said optical system being operative to project onto said eyeport an image, of said emitted light, indicating a deviation of the aiming axis from a second intermediate orientation with respect to said viewer axis, the aiming axis being at the desired orientation with respect to the user's line of sight when said viewer axis is at said first intermediate orientation with respect to the line of sight and the aiming axis is at said second intermediate orientation with respect to said viewer axis;

(d) positioning the device relative to said viewer so that said optical system receives said emitted light and projects said image onto said eyeport, said light emitted by said first light source being received via said first input element and said light emitted by said second light source being received by said second input element; and (e) further positioning the device relative to said viewer so that said image indicates that the aiming axis is at said second intermediate orientation with respect to said viewer axis.

22. The method of claim 21, wherein said first intermediate orientation is parallel to the user's line of sight.

23. The method of claim 21, wherein said first intermediate orientation is perpendicular to the user's line of sight.

24. The method of claim 21, wherein said second intermediate orientation is parallel to said viewer axis.

25. The method of claim 21, wherein said first light source and said second light source define between them an irradiator axis such that the aiming axis is at said second intermediate orientation with respect to said irradiator axis, and wherein said image of said emitted light includes a first spot of said light from said first light source and a second spot of said light from said second light source, said irradiator axis and said viewer axis being parallel when said first spot and said second spot coincide.

26. The method of claim 25, wherein the first color and said second color are substantially identical.

27. The method of claim 25, wherein said optical system is based on planar optics.

28. The method of claim 27 wherein said optical system includes a holographic plate including a first input holographic element and a second input holographic element that define between them said viewer axis.

29. The method of claim 21, further comprising the step of:

(f) compensating for parallax.

30. The method of claim 21, wherein said first and second light sources are passive.

* * * * *